US011808273B2

(12) United States Patent
Ehlers et al.

(10) Patent No.: US 11,808,273 B2
(45) Date of Patent: Nov. 7, 2023

(54) ROTOR ASSEMBLY

(71) Applicant: ebm-papst St. Georgen GmbH & Co. KG, St. Georgen (DE)

(72) Inventors: Volker Ehlers, St. Georgen (DE); Frederick Wursthorn, Villingen-Schwenningen (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 0 days.

(21) Appl. No.: 17/292,347

(22) PCT Filed: Oct. 21, 2019

(86) PCT No.: PCT/EP2019/078558
§ 371 (c)(1),
(2) Date: May 7, 2021

(87) PCT Pub. No.: WO2020/104127
PCT Pub. Date: May 28, 2020

(65) Prior Publication Data

US 2022/0003237 A1 Jan. 6, 2022

(30) Foreign Application Priority Data

Nov. 23, 2018 (DE) ..... 10 2018 129 612.6

(51) Int. Cl.
*F04D 25/06* (2006.01)
*F04D 17/16* (2006.01)
(Continued)

(52) U.S. Cl.
CPC ..... *F04D 25/062* (2013.01); *F04D 17/16* (2013.01); *F04D 29/0462* (2013.01);
(Continued)

(58) Field of Classification Search
CPC .... F04D 25/062; F04D 17/16; F04D 29/0462; F04D 29/083; F04D 29/4226; F04D 29/2266; F04D 13/0633
See application file for complete search history.

(56) References Cited

U.S. PATENT DOCUMENTS 5,692,886 A 12/1997 Kobayashi et al.
8,297,948 B2 * 10/2012 Laufer ..... F04D 13/0633 310/86

(Continued)

FOREIGN PATENT DOCUMENTS

DE 276 545 C 1/1914
DE 10 2013 109136 A1 2/2014

(Continued)

OTHER PUBLICATIONS

International Search Report and Written Opinion, dated Jan. 17, 2020, issued in the corresponding PCT Patent Application No. PCT/EP2019/078558, including English Translation of ISR.

(Continued)

*Primary Examiner* — Courtney D Heinle
*Assistant Examiner* — Andrew Thanh Bui
(74) *Attorney, Agent, or Firm* — Dickinson Wright PLLC

(57) ABSTRACT

The disclosure relates to a high-speed radial fan and to a rotor assembly (10) for a high-speed radial fan, comprising a bearing tube (20) which is axially open in the interior and in which a shaft (40) carrying a fan wheel (30) is mounted with a rotor (50), wherein the rotor (50) of the rotor assembly (10) is mounted in a cylindrical separating can (3).

10 Claims, 5 Drawing Sheets

(51) Int. Cl.

| | |
|---|---|
| ***F04D 29/046*** | (2006.01) |
| ***F04D 29/08*** | (2006.01) |
| ***F04D 29/42*** | (2006.01) |
| ***F04D 29/22*** | (2006.01) |

(52) U.S. Cl.
CPC ..... *F04D 29/083* (2013.01); *F04D 29/4226* (2013.01); *F04D 29/2266* (2013.01)

(56) References Cited

U.S. PATENT DOCUMENTS

| | | | | |
|---|---|---|---|---|
| 8,915,721 | B2 * | 12/2014 | Winkler | F04D 29/646 417/423.12 |
| 9,494,161 | B2 * | 11/2016 | Yoneda | H02K 11/33 |
| 9,970,450 | B1 | 5/2018 | Kelly | |
| 2009/0022607 | A1 * | 1/2009 | Jordan | F04D 29/059 417/420 |
| 2015/0143822 | A1 | 5/2015 | Chalmers et al. | |

FOREIGN PATENT DOCUMENTS

| | | | |
|---|---|---|---|
| DE | 10 2015 220988 | A1 | 4/2017 |
| DE | 11 2015 006 484 | T5 | 1/2018 |
| DE | 20 2018 103 573 | U1 | 7/2018 |
| KR | 2016 0097885 | A | 8/2016 |
| WO | 2016169610 | A1 | 10/2016 |

OTHER PUBLICATIONS

German Search Report dated Jul. 24, 2020, which issued in the corresponding Patent Application No. 10 2018 129 612.6.
Chinese Office Action dated Jul. 27, 2022, which issued in the corresponding Chinese Patent Application No. 201980074537.3.
European Search Report dated Mar. 10, 2023, which issued in the corresponding European Patent Application No. 19 794 120.6.
Korean Examiner Report dated Aug. 12, 2023, which issued in the corresponding Korean Patent Application No. 10-2021-7013660.

* cited by examiner

ROTOR ASSEMBLY

FIELD

The disclosure relates to a rotor assembly having a fan wheel as well as to a radial fan having such a rotor assembly.

BACKGROUND

With certain applications of radial fans, there is the basic problem that a seal is required between the rotor and the stator or the electronics system so that a fluid cannot reach the stator or the electronics housing.

There are already solutions for slowly running pumps, in which they are driven from the exterior by a magnetic mating coupling, via a magnetic coupling plate, through a separating can housing. This magnetic mating coupling is flanged-mounted, for example, directly or separately and driven by an electric motor.

This design comprises many components and requires a comparatively large installation space due to the magnetic coupling. With the high rotational speeds of a radial fan, a compact unit with a high power density accordingly cannot feasibly be realized with a separate magnetic coupling.

Sealing of the electronics area without a separating can with the aid of abrasive shaft seal rings generates undesirable friction and rapid wear. The high rotational speeds are also a limiting factor here.

SUMMARY

High-speed applications within the meaning of the present disclosure are rotational speeds of the fan wheel in which the circumferential speed at the outlet of the radial compressor is at least 60 m/s.

In this regard, the known solutions from the area of comparatively slowly rotating separating can pumps cannot be applied to high-speed fans when using canned motors.

Furthermore, the classic design requires a separation of the bearing seats. A precisely fitted bearing alignment of the bearings and bearing seats can only be ensured, however, with extensive effort. The alignment of such a unit must take place in two steps due to the bearings on both sides. First, the anchor must be balanced in a first step; subsequently, the entire unit must be balanced because the anchor is inaccessible.

In the event that access will be made to a split or multi-part housing for a fluid seal or, for example, to a separating can open on one side, there is always still the problem of the seal between the stator and the rotor after installation of the rotor unit. Thus, the rotor unit can initially be completely assembled, for example, when the bearing tube is attached, for example, as an injection-molded component in the primary housing. However, in this case it is necessary that the separating can is designed to be open from the rear, and thus it must be closed and sealed off after completion of all assembly steps.

Aspects of example embodiments overcome the aforementioned disadvantages and provide a rotor assembly of a radial fan, particularly of a high-speed radial fan, which provides an optimized assembly option and with which a seal can simultaneously be obtained between the rotor and the stator while simultaneously having good efficiency.

These aspects of example embodiments are achieved by the combination of features according to claim 1, for example.

According to an example embodiment, a rotor assembly for a high-speed radial fan is proposed for this, comprising a bearing tube which is axially open in the interior and in which a shaft carrying a fan wheel is mounted with a rotor, in which the rotor of the rotor assembly is mounted in a cylindrical separating can of a housing.

A further aspect of the an example embodiment relates to a radial fan having a fan housing, which is formed as a single piece with the separating can and, accordingly, the rotor assembly is housed in the separating can of the fan housing.

In one advantageous example embodiment of the disclosure, it is provided in this case that the bearing tube with the shaft and the rotor mounted on the shaft is arranged in the separating can, which is closed around the circumference.

In one preferred embodiment, a design is provided, in which the separating can extends away from a substantially flat housing base plate of the fan housing in the axial direction. It is likewise advantageous if an air gap is formed between the rotor and a stator surrounding the rotor (50), and the separating can with its cylindrical separating can walls is arranged within the air gap. In this manner, a drive of the fan shaft can be realized without the necessity of a magnetic coupling.

It is further preferred when the material of the separating can is not a good electrical conductor, because this leads to eddy-current losses due to the rotating magnets. The contact resistance of the separating can material should not be below 10 Ohm. A magnetic permeability of the separating can material should likewise be close to 1, because, otherwise, parts of the magnetic field become shielded.

In a likewise advantageous embodiment of the disclosure, it is provided that the shaft, on a first bearing arranged in the bearing tube and a second bearing arranged in the bearing tube spaced apart in the axial direction as relates to the first, are mounted centrally in a region between the fan wheel and the rotor.

The topology of the motor is optimized accordingly for high speeds. In order to reduce the speed of the electrical field, the rotor has the minimum number of pole pairs of 1 or 2 poles. It is thereby possible to accommodate a large magnetic air gap without having to accept excessively large losses in efficiency in this case. The separating can which separates the rotor region from the stator region can be placed in this magnetic air gap. In one advantageous embodiment of the disclosure, it is accordingly provided that the rotor of the motor has precisely 2 or 4 poles.

In a further advantageous embodiment of the disclosure, it is provided that the stator is surrounded by a housing, which provides a receiving compartment for the stator and preferably motor electronics installed in the receiving compartment, in which the housing is sealed off to the fan housing and is connected thereto.

To make assembly easier, the bearing tube with a radial overhang rests upon a housing base plate of the fan housing and is connected to the fan housing by means of a connection assembly, in which the overhang extends, at least partially, over the outer circumference of the fan wheel.

The advantages of the example embodiments can therefore be summarized as follows:

- best-possible sealing tightness between the rotor and the electronics region due to the single-part, seamless separating can;
- compact design with few components due to the direct drive of the rotor by means of the stator without a magnetic coupling;

good suitability for high-speed operation due to the central bearing tube and ease of balancing the service bearings;

improved dissipation of the occurring heat losses due to the high power density.

The design can be adapted further at various operating points due to the various scaling options. Such scaling options include, for example, the fan diameter, the fan rotational speed, the fan shape, the height of the fan blade, the cross-section of the spiral housing, the diameter of the connecting pieces, the size of the ball bearings, the active length of the motor, the diameter of the stator, the diameter of the magnet, the size of the air gap, the construction of the circuit board, the winding configuration, and the shaft diameter.

BRIEF DESCRIPTION OF THE DRAWINGS

Other advantageous further embodiments of the disclosure are characterized in the dependent claims and/or are shown in more detail in the following by means of the figures, along with the description of the example embodiments of the disclosure. The following is shown:

DETAILED DESCRIPTION OF EXAMPLE EMBODIMENTS

Figure 1:
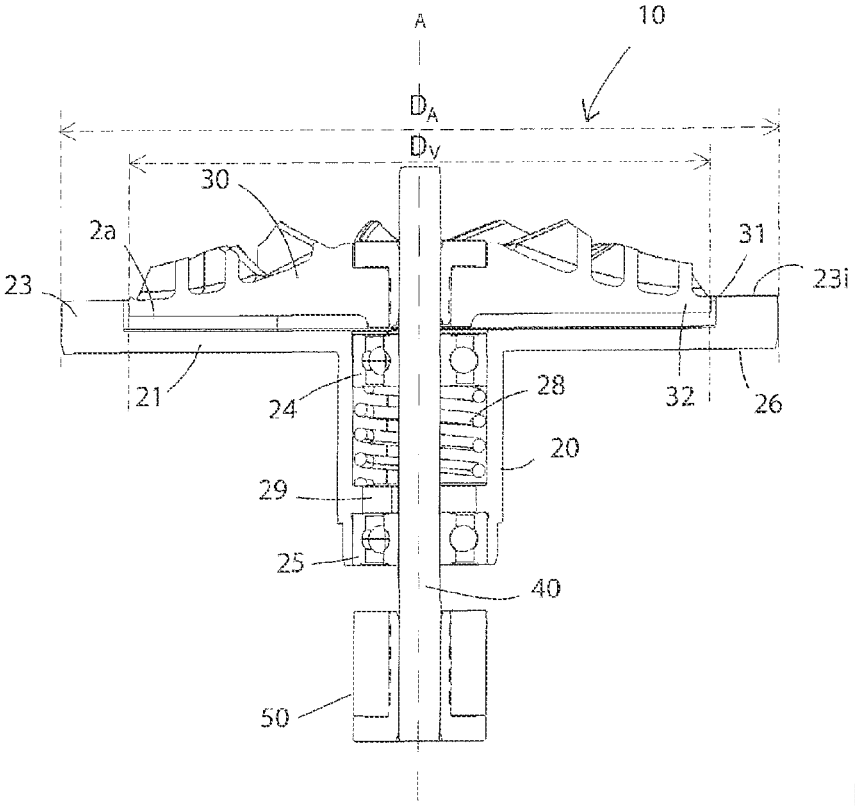
FIG. 1 is a sectional view through an example embodiment of a rotor assembly.

The example embodiments of the disclosure is described in more detail in the following with reference to FIGS. 1 to 8, wherein use of the same reference numerals indicates the same structural and/or functional features.

Figure 2:
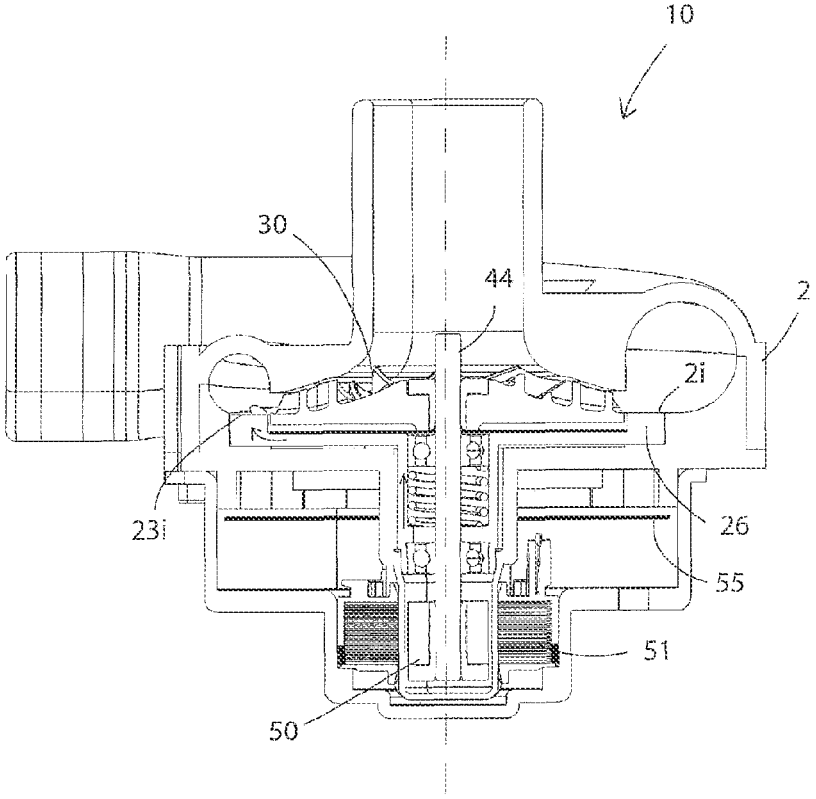
FIG. 2 is a sectional view through an example embodiment of a radial fan.
Figure 3:
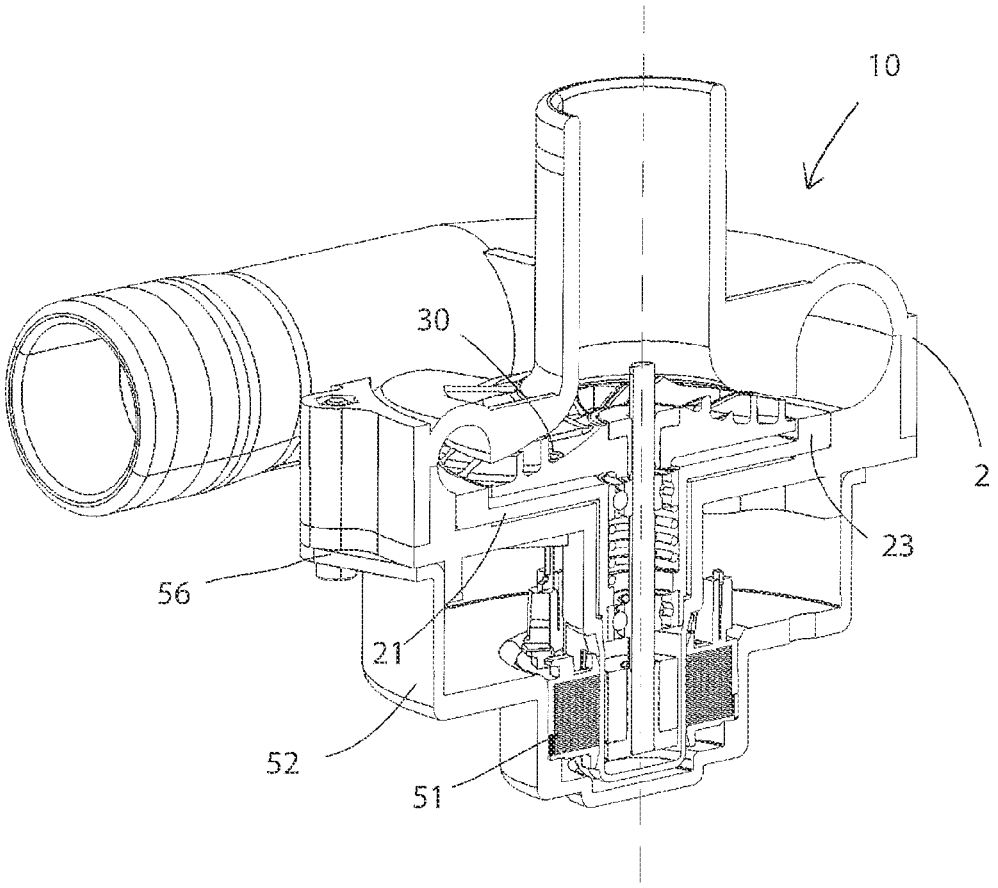
FIG. 3 is a perspective sectional view through the example embodiment according to FIG. 2.
Figure 4:
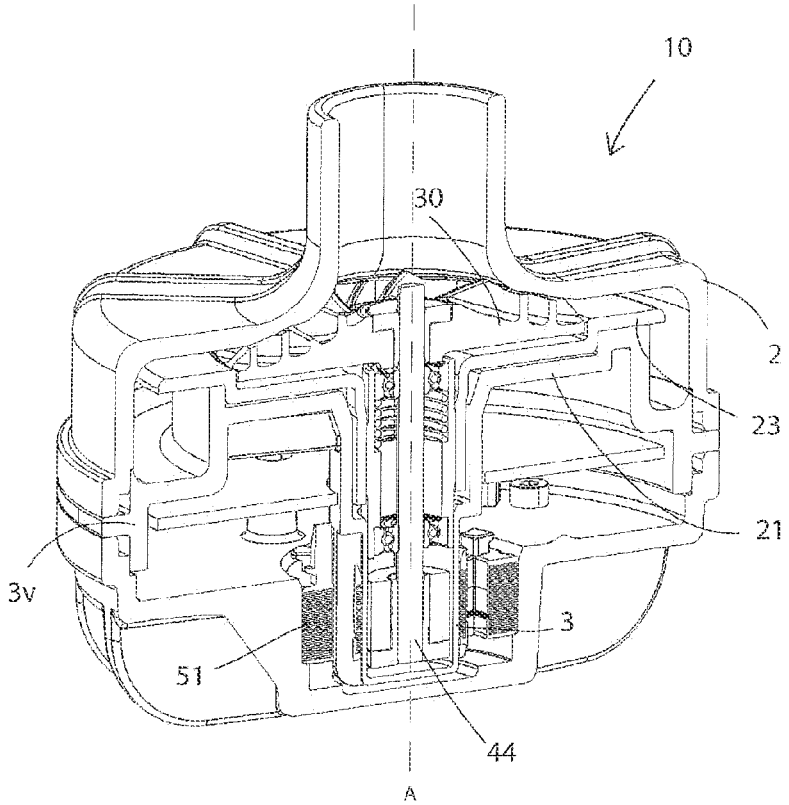
FIGS. 4, 5, 6, 7 and 8 are further example embodiments of the disclosure.
Figure 5:
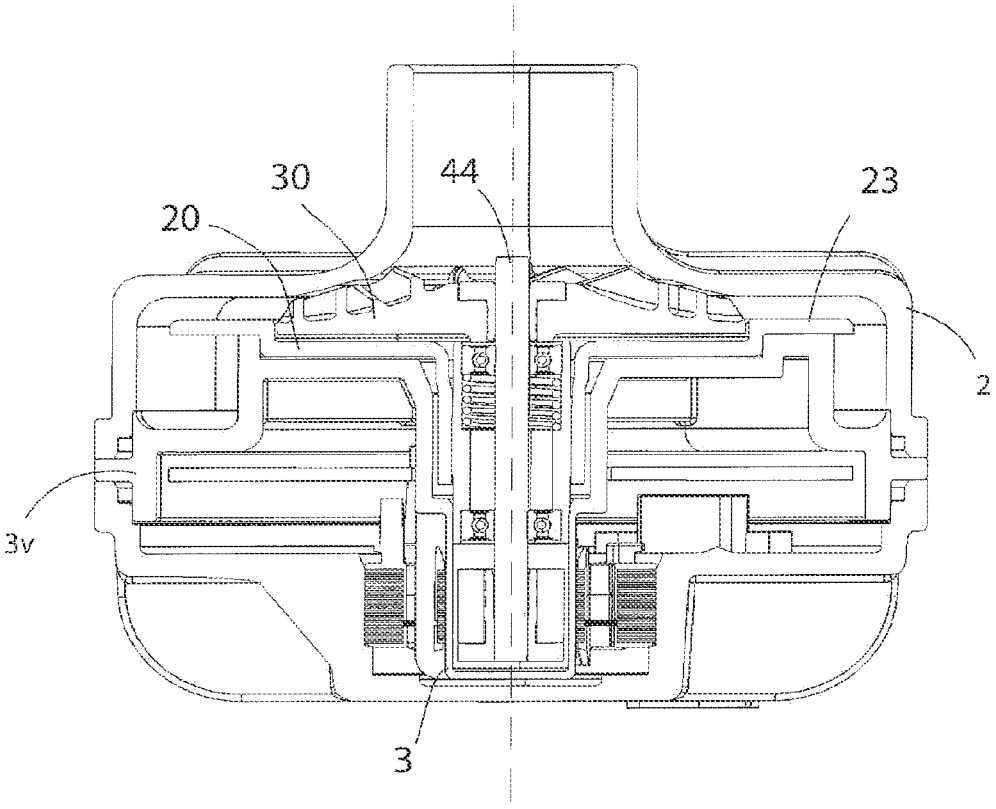
Figure 6:
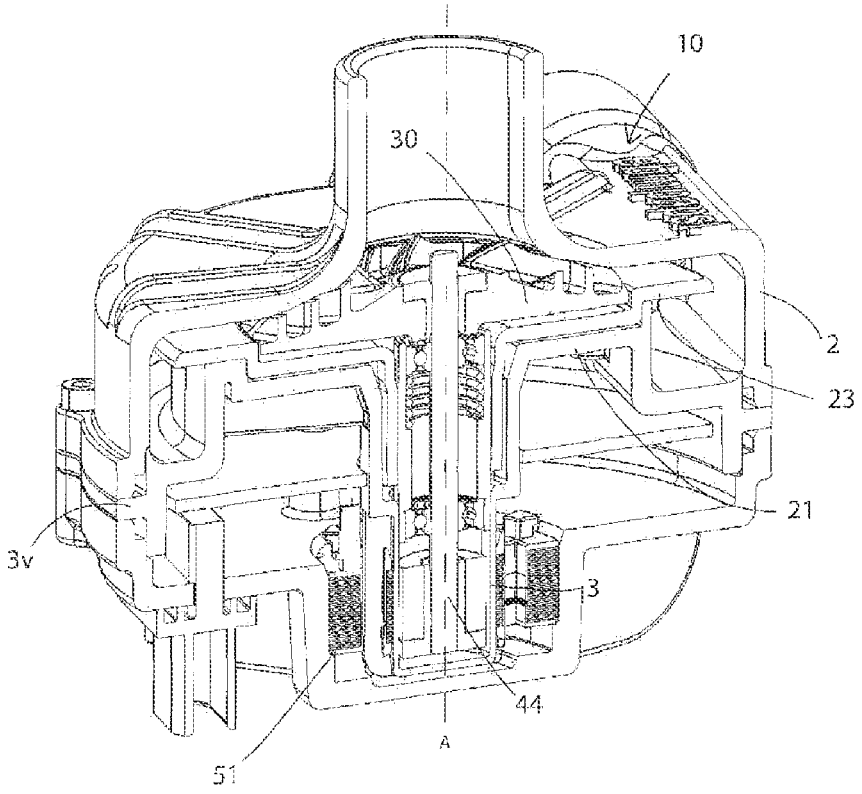
Figure 7:
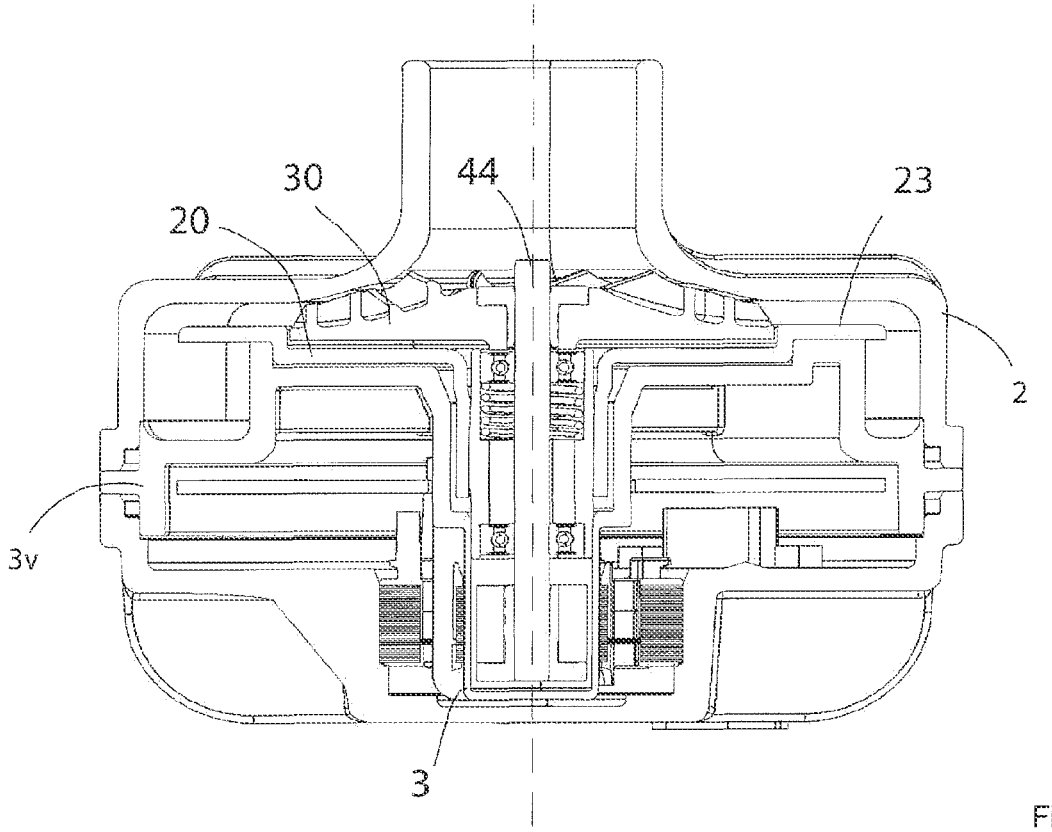

FIGS. 2 and 3 show an exemplary embodiment of a high-speed radial fan 1 having a rotor assembly 10.

The rotor assembly 10 comprises a bearing tube 20 which is open axially in the interior. A shaft 40 is mounted in the bearing tube 20, in which a rotor 50 of a canned motor is mounted on the shaft 40. An air gap is formed between the rotor 50 and a stator 51 surrounding the rotor 50, and the separating can with its cylindrical separating can walls 3*a* is arranged within the air gap. The motor stator 51, which is external in this respect, is then arranged in a housing 52. In this exemplary embodiment, the rotor 50 has precisely 2 poles.

The housing 52 forms a receiving compartment for the stator 51 and the motor electronics 55, in which the housing 52 is sealed off at sealing surfaces 56 as relates to the fan housing 2 and is connected thereto.

The bearing tube 20 has an overhang 21 which protrudes outwardly radially.

The sectional view according to FIG. 1 shows that the overhang 21 extends over the outer circumference 31 of the fan wheel 30. The overhang 21 is substantially formed as a round plate-shaped overhang, the diameter of which is greater than the diameter of the fan wheel 30.

The overhang 21 further has a collar 23, which extends outwardly circumferentially and protrudes upwardly, and which extends in the axial direction A and surrounds the radial edge region 32 of the fan wheel 30 radially outwardly. In other words, the fan wheel 30 is placed on the shaft 40 such that the fan wheel 30 is arranged in the overhang 21 in the recess.

The shaft 40 is mounted between two bearings 24, 25, in which a spring 28 is preloaded against the first bearing 24, which is supported on an inner bar 29. The second (lower bearing 25 in FIG. 1) is situated on the lower end of the bearing tube 20 and mounted flush with the bar 29. The shaft 40 with the rotor 50 protrudes through the lower bearing 25.

FIGS. 1 and 2 further show the fan housing 2. In this case, the bearing tube 20 with the shaft 40 and the rotor 50 mounted on the shaft 40 protrudes into a separating can 3 (open at the top) which is closed around the circumference, and which is part of the fan housing 2 of the radial fan 1 and is formed as a single piece therewith.

The separating can 3 of the housing 2 extends away from a substantially flat housing base plate 2*a* of the fan housing 2 in the axial direction. The bearing tube 20 is mounted with its radial overhang 21 on the housing base plate 2*a* and is connected to the fan housing 2 by means of a screw connection.

Figure 8:
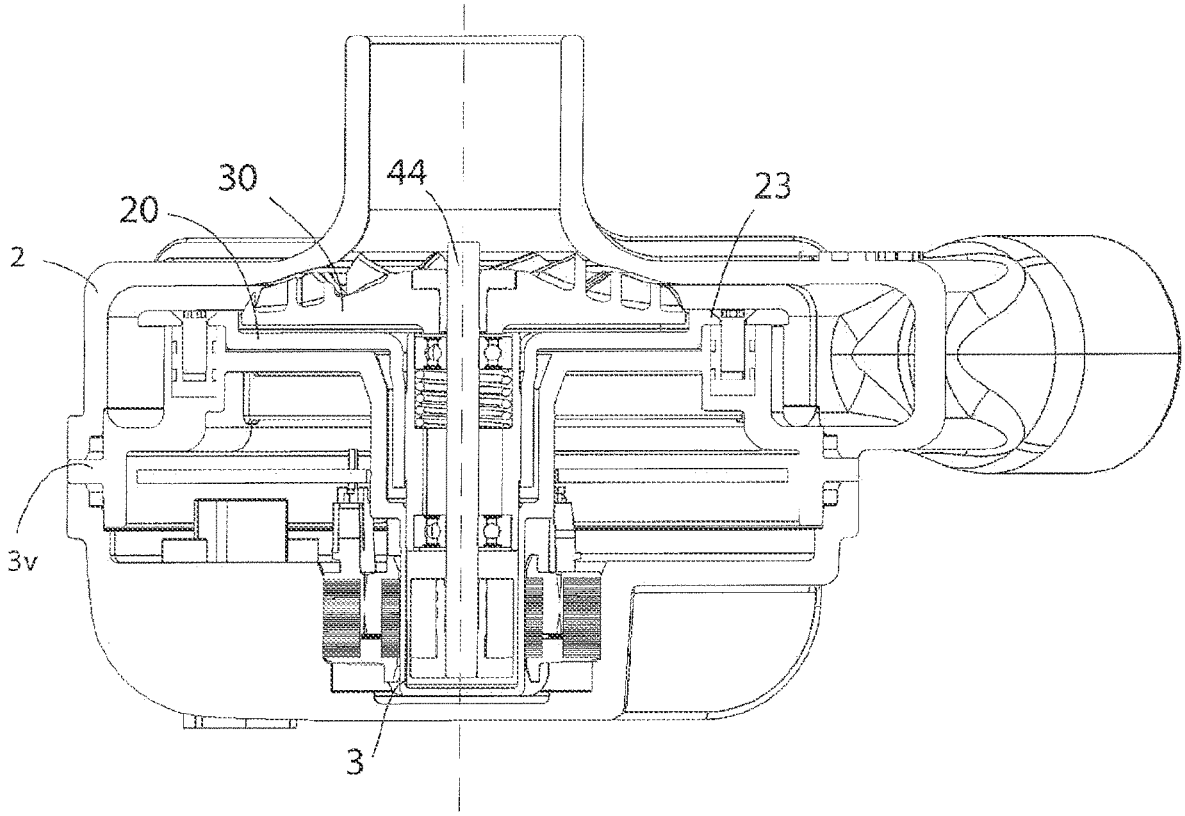

FIGS. 4 to 8 show further embodiments of the disclosure, in which particularly the design of the housing 2, of the separating can 3, of the bearing tube 20, and the design of the heat-dissipating section 23 are shown in an alternative form. The overhang of the separating can 3*v* which extends between an upper part and lower part of the housing 2 can also be seen. FIG. 8 further shows that an attachment opening is provided in the region of the heat-dissipating section 23 in order to attach the overhang of the bearing tube 20 to the overhang of the separating can 3.

The claimed invention is not limited in its design to the aforementioned example embodiments. Rather, a number of variants is conceivable, which would make use of the solution shown even with essentially different designs. Thus, the design of correspondingly application-specific scaling options could be adapted to the application, as previously explained.

The invention claimed is:

1. A high-speed radial fan (1) comprising:

a rotor assembly (10) comprising a bearing tube (20) which is axially open in the interior and in which a shaft (40) carrying a fan wheel (30) is mounted with a rotor (50), wherein the rotor (50) of the rotor assembly (10) is mounted in a cylindrical separating can (3);

a fan housing (2) comprising an upper part and a lower part, the upper part surrounding at least the fan wheel (30) and the lower part corresponding to a housing (52) that surrounds the separating can (3) and a stator (51) and provides a receiving compartment for the stator (51) and motor electronics installed in the receiving compartment, wherein the housing (52) is connected to the upper part of the fan housing (2);

wherein the separating can (3) has an overhang which extends between the upper part of the fan housing (2) and the housing (52).

2. The radial fan (1) according to claim 1, characterized in that the upper part of the radial fan has a fan housing (2) is formed as a single piece with the separating can (3).

3. The radial fan (1) according to claim 1, characterized in that the bearing tube (20) with the shaft (40) and the rotor (50) mounted on the shaft (40) is arranged in the separating can (3), which is closed around the circumference.

4. The radial fan (1) according to claim 2, characterized in that the separating can (3) extends away from a substantially flat housing base plate (2*a*) of the fan housing (2) in the axial direction.

5. The radial fan (1) according to claim 1, characterized in that an air gap is formed between the rotor (50) and the stator (51) surrounding the rotor (50), and the separating can (3) with its cylindrical separating can walls (3*a*) is arranged within the air gap.

6. The radial fan (1) according to claim 1, characterized in that the material of the separating can (3) is an isolator or has a contact resistance greater than 10 Ohm.

7. The radial fan (1) according to claim 1, characterized in that the shaft (40), on a first bearing (24) arranged in the bearing tube (20) and a second bearing (25) arranged in the bearing tube (20) spaced apart in the axial direction as relates to the first, are mounted in a region between the fan wheel (30) and the rotor (50).

8. The radial fan (1) according to claim 1, characterized in that the rotor (50) has precisely 2 or precisely 4 poles.

9. The radial fan (1) according to claim 1, wherein the housing (52) is sealed off from the fan housing (2).

10. The radial fan (1) according to claim 1, characterized in that the bearing tube (20) with a radial overhang (21) rests against a substantially flat housing base plate (2*a*) and is connected to the fan housing (2) by means of a connection assembly, wherein the overhang (21) extends, at least partially, over an outer circumference (31) of the fan wheel (30).

* * * * *